US005152457A

United States Patent [19]

Burwell et al.

[11] Patent Number: 5,152,457

[45] Date of Patent: Oct. 6, 1992

[54] ULTRASONIC MIST GENERATOR WITH MULTIPLE PIEZOELECTRIC CRYSTALS

[75] Inventors: Donald E. Burwell, Wethersfield; James L. Yanosy, Granby, both of Conn.

[73] Assignee: United Technologies Corporation, Hartford, Conn.

[21] Appl. No.: 752,398

[22] Filed: Aug. 30, 1991

[51] Int. Cl.[5] ..... B05B 1/08

[52] U.S. Cl. ..... 239/102.2; 310/323

[58] Field of Search ..... 239/102.2; 310/323, 310/324

[56] References Cited

U.S. PATENT DOCUMENTS 4,123,481 10/1978 Herold et al. ..... 261/81

4,659,014 4/1987 Soth et al. ..... 239/102.2

*Primary Examiner*—Andres Kashnikow

*Assistant Examiner*—Lesley Morris

[57] ABSTRACT

An ultrasonic piezoelectric aerosol submicron mist generator is disclosed having an interior cavity (15) containing at least two high-frequency, piezoelectric crystals (20). The piezoelectric crystals (20) are vibratible at a selected frequency to atomize a liquid (36) that has been distributed over the surface (22) of the crystals (20) via annular flow washers (40). The atomized liquid (36) forms a mist (42) thereafter received into a mixing chamber (44) wherein the mist (42) is entrained into a low pressure gas (46). The low pressure gas (46) transports the entrained mist (42) about a separator plate (50), whereby the mist (42) must change flow direction in order to exit a nozzle outlet (18) thus forcing droplets (52) larger than the desired size to separate from the low pressure gas (46) before reaching the nozzle outlet (18).

9 Claims, 3 Drawing Sheets

ULTRASONIC MIST GENERATOR WITH MULTIPLE PIEZOELECTRIC CRYSTALS

TECHNICAL FIELD

This invention relates to ultrasonic generation of an aerosol mist, and more particularly to a high-frequency piezoelectric mist generator wherein a liquid is atomized into a carrier gas to produce an aerosol mist containing very fine droplets from less than 1 to 15 microns in diameter.

BACKGROUND ART

Atomization is used to produce sprays and mists employed in a variety of industrial applications such as combustion, process industries, agriculture, meteorology, and medicine. A major concern in atomization is the size of the drops produced since some applications, such as combustion, require small droplets, where in other areas, such as crop spraying small droplets must be avoided. The primary techniques currently used for atomizing a liquid are pressure, rotary, pneumatic, ultrasonic, and electrostatic. Although conventional atomizers employing such techniques function well for most industrial applications, they are incapable of reliably producing submicron droplets—an important requirement in applications where the presence of larger droplets would cause operational difficulties in subsequent utilization.

In conventional ultrasonic atomizers, the liquid is fed into an atomizing nozzle and then flows through or over a piezoelectric transducer and horn, which vibrate at ultrasonic frequencies to produce short wavelengths that atomize the liquid. Typically, such conventional ultrasonic atomizing nozzles incorporate a low-frequency electrical input from 25 to 120 kHz, two piezoelectric transducers, and a stepped horn to produce weight mean droplet diameters in the range of 25 to 100 microns. Other conventional ultrasonic atomizers have been used in medical applications to produce droplets in the range of 1 to 5 microns, however, they are not able to produce submicron droplets required in some industrial applications.

DISCLOSURE OF THE INVENTION

An object of the invention is to provide an apparatus for producing a submicron aerosol mist. Another object is to provide an apparatus for producing a submicron aerosol mist, which apparatus is capable of being designed to function with its nozzle disposed in a variety of orientations.

According to the present invention, an ultrasonic piezoelectric aerosol submicron mist generator includes an interior cavity containing at least two high-frequency, piezoelectric crystals each having a positive and a negative surface which vibrates at a selected frequency to atomize a liquid that has been distributed over the positive surface of the crystals via annular flow washers, thereby producing a mist thereafter received into a mixing chamber wherein the mist is entrained into a low pressure gas that transports it about a separator plate disposed within the interior cavity adjacent to a nozzle outlet, whereby the mist must change flow direction in order to exit the nozzle outlet thus forcing droplets larger than the desired size to separate from the carrier gas before reaching the nozzle outlet.

Each piezoelectric crystal is supported and held in place by an elastomeric ring which also functions as a seal to prevent liquid from flowing to the negative surface of the crystal. The flow washers comprise a wick like material, such as felt, or other material which will function to distribute the liquid over the piezoelectric crystals at a predetermined flow rate.

Additionally, the droplet size may be regulated by varying the frequency of the piezoelectric crystals thereby permitting smaller droplets to be produced when utilizing higher frequency crystals. The frequency of the crystals increases as their thicknesses decrease, thus a range of droplet sizes may be created by varying the thickness of the crystals. This may be effected by changing the elastomeric rings to compensate for crystals of different thicknesses and thereby to ensure a tight fit irrespective of the thickness of the crystal itself.

According to a further aspect of this invention, the separator plate is disposed in the mixing chamber such that the mist entrained in the low pressure gas must negotiate a 90–180 degree turn around the separator plate which causes a sharp change in flow direction and forces droplets larger than the desired size to separate from the carrier gas, impinge on the walls of the nozzle, and thereafter flow out a drain. Droplets of the desired size successfully negotiate the turn around the separator plate and thereafter flow out of the nozzle outlet.

The nozzle of the invention provides good atomization at predetermined flow rates and produces droplets in the range of less than 1 to 15 microns in diameter through a nozzle that can be designed to be used in a variety of orientations. The nozzle of the invention has low power requirements, may be implemented using any flowable liquid, and is free from flow instabilities. The mist generator is inexpensive, light weight, easy to maintain and remove for servicing, durable, easily manufactured and assembled, and can be made of any available material which can be formed into the proper configuration.

The foregoing and other objects, features and advantages of the present invention will become more apparent in the light of the following detailed description of exemplary embodiments thereof, as illustrated in the accompanying drawings.

BEST MODE FOR CARRYING OUT THE INVENTION

Figure 1:
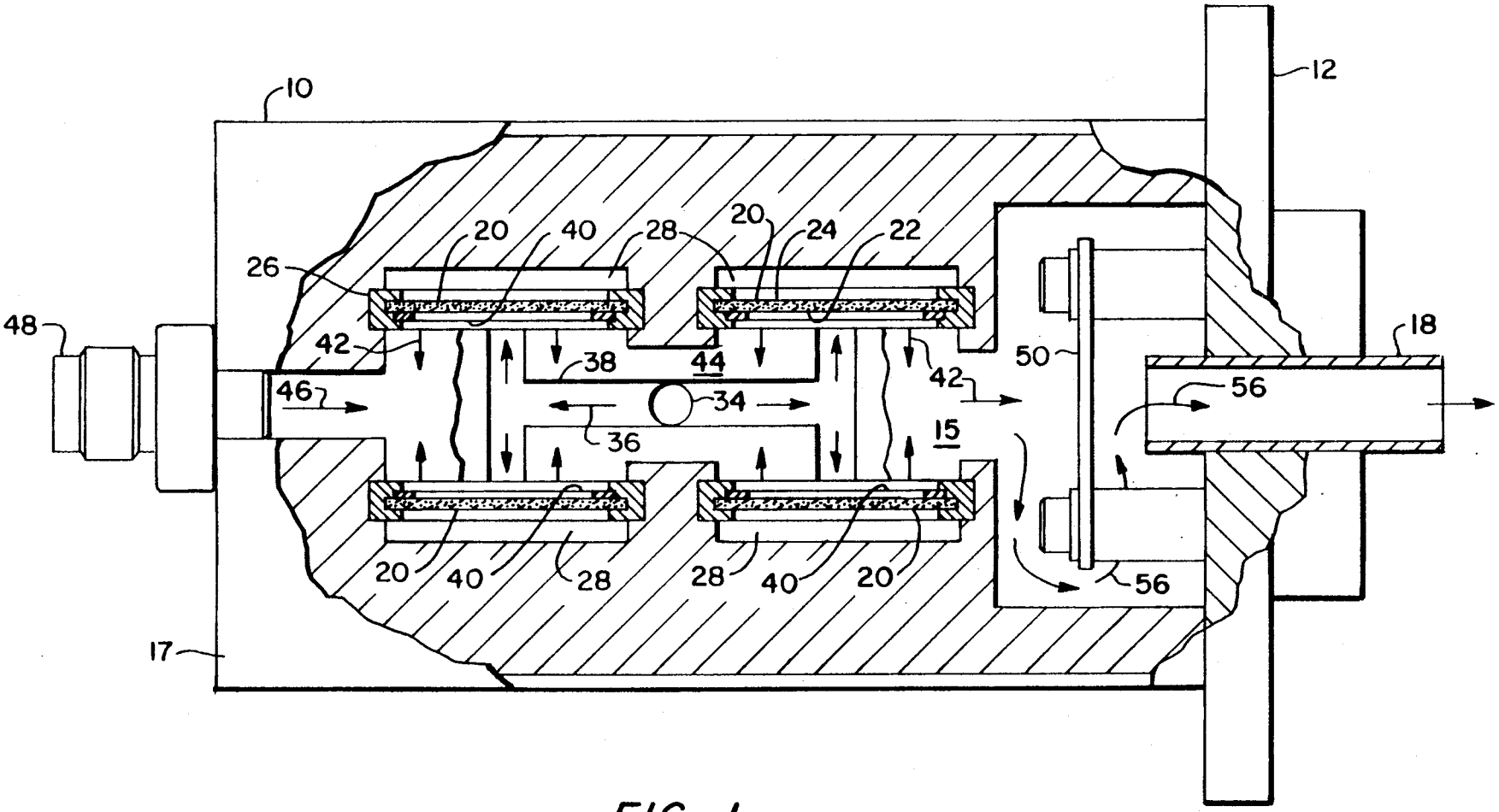
FIG. 1 is a partially broken away, plan view of an ultrasonic piezoelectric mist generator in accordance with the present invention with its top plate partially broken away.
Figure 2:
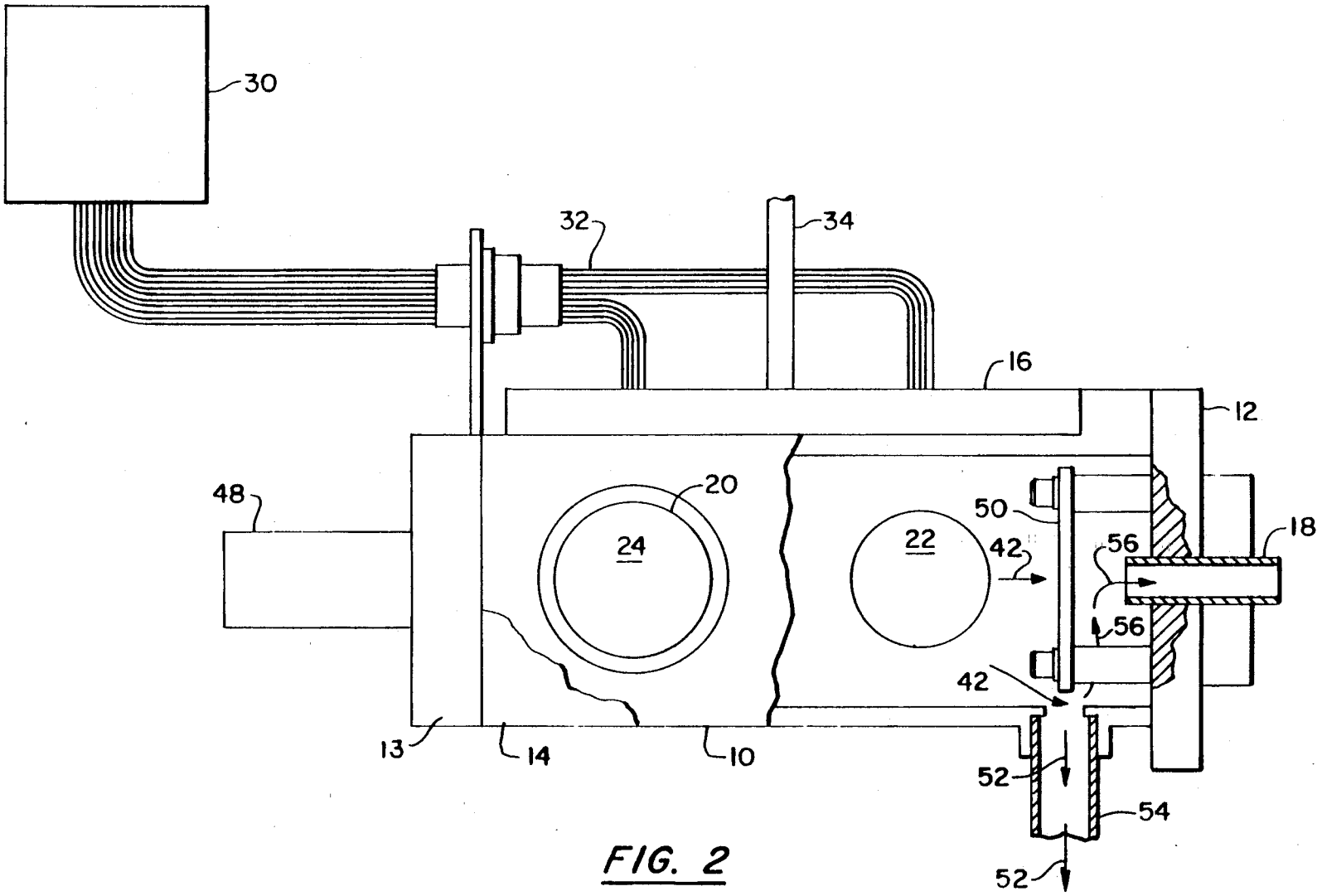
FIG. 2 is a partially broken away, sectioned side elevational view of the ultrasonic piezoelectric mist generator of FIG. 1 with its side plate removed.

Referring now to FIGS. 1–2, an ultrasonic piezoelectric submicron aerosol mist generator includes a rectangular nozzle body 10 having two side plates 14, opposite a top plate 16, and a bottom plate 17 and capped at its ends by a face plate 12 and a base plate 13 respectively. The nozzle body 10 defines an interior cavity 15 therein and includes a nozzle outlet 18 centrally disposed within the face plate 12 and opening into the interior cavity 15. A plurality of piezoelectric crystals 20, each having a front surface 22 facing the interior cavity 15 and a back surface 24 on the opposite side thereof, are disposed within the interior cavity 15 in opposing pairs. Each of the piezoelectric crystals 20 is supported by an elastomeric ring 26 which wraps around the periphery of both the front 22 and back 24 surfaces of the crystals 20 and is disposed in a recess 28 in the nozzle body 10 that extends outwardly from the interior cavity 15. Additionally, an annular flow washer 40 is disposed on the front surface 22 of each piezoelectric crystal 20 within the periphery of the elastomeric rings 26 to evenly distribute a flowable liquid 36 to be atomized over the front surface 22 of the crystal 20.

The piezoelectric crystals 20 are operatively connected to an electrical controller 30 via electrical leads 32 which pass through the nozzle body 10 to attach to each piezoelectric crystal 20 on the back surface 24. The electrical controller 30 generates a signal, such as a 1 MHz sine wave signal, to vibrate the piezoelectric crystals 20.

A liquid inlet 34 is provided in the center of the top plate 16 to receive a flowable liquid 36, typically at a pressure of 2–20 psig. Thereafter the liquid 36 flows from the inlet 34 through a fluid passageway 38 for distribution to wet each of the annular flow washers 40. The flow washers 40 then distribute the liquid 36 over the piezoelectric crystals 20. The annular flow washers 40 comprise a wick like material, such as felt, or other material which allows liquid to pass through it at a desired flow rate.

By vibrating each of the piezoelectric crystals at a desired frequency, the liquid 36 delivered through the annular flow washers 40 onto the front 22 surface of the crystals 20 is atomized, thereby producing a mist 42. The mist 42 formed by atomizing the liquid 36 delivered through the flow washer 40 onto the front surface 22 of the piezoelectric crystals 20 is received into a mixing chamber 44 portion of the interior cavity 15 disposed between the opposing pairs of flow washers 40. The mist 42 is entrained into a low pressure gas 46 which enters the mixing chamber 44 via a gas inlet 48 located in the wall at the end of the nozzle body 10 opposite the face plate 12, flows axially through and exits the mixing chamber 44 via the nozzle outlet 18. The gas 46 carries the mist 42 about a separator plate 50 disposed within the interior cavity 15 adjacent to the nozzle outlet 18 such that the mist 42 entrained in the gas 46 must negotiate a 90–180 degree turn around the separator plate 50 in order to flow out of the nozzle outlet 18. Negotiating the turn about the separator plate 50 causes a sharp change in flow direction. Thus, due to their larger momentum, droplets 52 larger than the desired size cannot negotiate the sharp turn but rather separate from the carrier gas 46, impinge on the walls of the nozzle body 10, and thereafter flow out a drain 54 in the side wall of the nozzle body 10. Droplets 56 of the desired size successfully negotiate the turn around the separator plate 50 and thereafter flow out of the nozzle outlet 18. The flow rate of the droplets 56 of the desired size out of the nozzle outlet 18 may be rapidly changed by varying the velocity at which the carrier gas 46 is injected into the nozzle body 10.

The elastomeric rings 26 cushion the piezoelectric crystals 20 and also function as a seal to prevent the liquid 36 delivered onto the front surface 22 of the crystals 20 from flowing around the sides of the piezoelectric crystals 20 onto the back surface 24. Droplet size may be regulated by varying the frequency of the piezoelectric crystals 20 thereby permitting smaller droplets to be produced when utilizing higher frequency crystals 20. The frequency of a given piezoelectric crystal 20 increases as the thickness of the crystal 20 decreases, thus by adjusting the elastomeric rings 26 to accommodate piezoelectric crystals 20 of varying thicknesses a range of droplet sizes may be created.

The piezoelectric crystals 20 typically comprise Lead Titanate Zirconate, although other piezoelectric materials may be utilized which are capable of vibrating at an amplitude and frequency which will properly atomize the liquid 36.

Figure 3A:
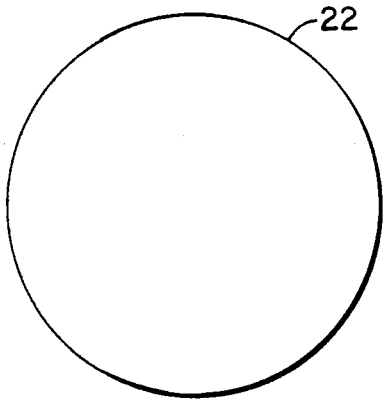
FIG. 3*a* is a plan view of the front surface of a piezoelectric crystal in accordance with the present invention.
Figure 3B:
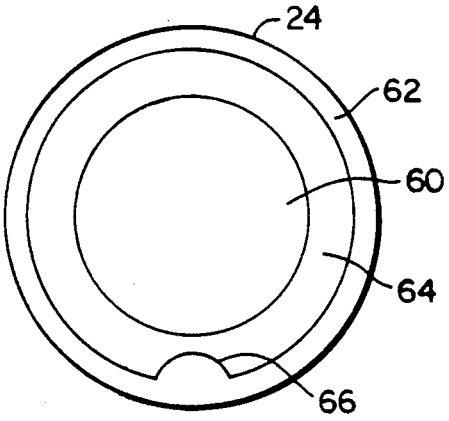
FIG. 3*b* is a plan view of the back surface of a piezoelectric crystal in accordance with the present invention.

Referring now to FIGS. 3*a* and 3*b*, the piezoelectric crystals 20 are completely plated on their front surface 22, which is inherently positive, typically to a thickness of 2–4, mils with a plating substance such as electroless nickel or gold. The plating from the front surface 22 of the crystals 20 extends over the outer circumference onto the back surface 24 of the crystals 20 and forms a positively plated ring 62 on the back 24 surface. The back surface 24 of the crystals which is inherently negative is plated with the same material utilized on the front surface 22, but in a pattern which allows the vibration of the crystals 20 to be concentrated in a central circular region 60. The pattern comprises the outer positively plated ring 62 which typically has a thickness of 2–4 mils and extends 0.063 inches radially inward toward the center of the crystal 20, and a middle ring 64, which typically extends from the edge of the positive ring 62 inwardly 0.137 inches toward the center of the crystal 20 and is not plated. The central, circular region 60 is negative and is plated, typically to a thickness of 2–4 mils with a diameter of 0.600 inches. The positively plated ring 62 also includes a semi-circular tab 66, which typically extends 0.087 inches into the non-plated region and is provided as a means for soldering one of the electrical leads 32 to a positive connection. By so plating the crystals 20 the power of the crystals 20 is concentrated in the central, circular region 60 thereby increasing the vibrational amplitude of the crystals 20 in that region 60. The increased vibrational amplitude allows any flowable liquid 36 to be evenly distributed over the crystals 20 and hence atomized.

The nozzle body 10 may be made of any material, such as brass, with suitable properties, for example strength and corrosion resistance, appropriate for the environment for which it is to be used and which is otherwise compatible with the liquid 36 being atomized. When atomizing corrosive liquids, it may be necessary to coat the piezoelectric crystals 20 with a corrosion resistant material such as gold.

The drain 54 should be sized relative to the nozzle outlet 18 so as to allow droplets 52 larger than the desired size to flow out of the nozzle body 10 via the drain 54 without inducing the carrier gas 46 with droplets 56 of the desired size entrained therein to flow out of the drain 54 instead of the nozzle outlet 18.

Although the invention has been shown and described with respect to exemplary embodiments thereof, it should be understood by those skilled in the art that various changes, omissions, and additions may be made therein and thereto, without departing from the spirit and the scope of the invention.

We claim:

1. An apparatus for generating a mist comprising:

a nozzle body having an interior cavity and a nozzle outlet opening into the interior cavity;

a plurality of piezoelectric crystals disposed within the interior cavity, said piezoelectric crystals having a surface circumscribed by a periphery for receiving a liquid to be atomized and being vibratible at a selected frequency so as to atomize the liquid received thereon into droplets;

a mixing chamber disposed between said piezoelectric crystals for receiving the droplets of atomized liquid from the surface of said piezoelectric crystals;

an annular flow washer disposed adjacent to the periphery of each piezoelectric crystal for distributing the liquid to be atomized over the surface thereof, said flow washer comprising a wick-like material;

means for uniformly delivering the liquid to be atomized through the nozzle body to said flow washer; and means for injecting a low pressure gas into said mixing chamber at a desired rate as a carrier gas for entraining and carrying the droplets of atomized liquid through said nozzle outlet.

2. Apparatus according to claim 1, further comprising:

a separator plate disposed within said interior cavity adjacent to said nozzle outlet whereby the carrier gas and the droplets of the atomized liquid entrained in the carrier gas must pass about said separator plate in order to flow out said nozzle outlet thereby causing an oversize portion of the droplets of the atomized liquid to separate therefrom.

3. Apparatus according to claim 2, further comprising:

means for draining the droplets of the atomized liquid separated from the gas out of the nozzle body.

4. Apparatus according to claim 1, wherein said piezoelectric crystals comprise a piezoelectric material consisting of Lead Titanate Zirconate.

5. Apparatus according to claim 1, wherein said piezoelectric crystals comprise;

a completely plated front surface facing said interior cavity, said front surface being inherently positive; and a back surface being inherently negative on the opposite side of the front surface plated with the same material utilized on the front surface, said plating being in a pattern which allows the vibration of the piezoelectric crystals to be concentrated in the center of the back surface.

6. Apparatus according to claim 5, wherein the completely plated front surface comprises a plating substance plated to a thickness of 2–4 mils.

7. Apparatus according to claim 5, wherein said pattern on the back surface comprises;

an outer, positively plated ring extending from the front surface over the outer circumference of said piezoelectric crystals to the back surface, said positively plated ring extending 0.063 inches radially inward toward the center of said piezoelectric crystals;

a middle ring extending from the edge of said positively plated ring inwardly 0.137 inches toward the center of said piezoelectric crystals, said middle ring not being plated;

a central, circular region extending from the middle of said piezoelectric crystals to the edge of said middle ring, said circular region being negative and having a diameter of 0.600 inches; and a plating substance plated on said positively plated ring and said circular region to a thickness of 2–4 mils.

8. Apparatus according to claim 7 further comprising;

a semi-circular tab which extends 0.087 inches from said positively plated ring into said middle ring for soldering an electrical lead.

9. Apparatus according to claim 1 further comprising;

a plurality of recesses disposed within the nozzle body and extending outwardly from said interior cavity for housing said piezoelectric crystals; and a plurality of elastomeric rings about the periphery of each piezoelectric crystal disposed in said recess for supporting said piezoelectric crystals.

* * * * *